US006935905B2

(12) United States Patent
Aihara et al.

(10) Patent No.: US 6,935,905 B2
(45) Date of Patent: Aug. 30, 2005

(54) CONNECTOR, A CONNECTOR ASSEMBLY, A JIG, AND A METHOD FOR WITHDRAWING A TERMINAL IN A CONNECTOR

(75) Inventors: Tetsuya Aihara, Yokkaichi (JP); Michiaki Okamoto, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/925,622

(22) Filed: Aug. 25, 2004

(65) Prior Publication Data

US 2005/0020132 A1 Jan. 27, 2005

Related U.S. Application Data

(62) Division of application No. 10/757,699, filed on Jan. 14, 2004.

(30) Foreign Application Priority Data

Jan. 16, 2003 (JP) ..... 2003-007760
Feb. 14, 2003 (JP) ..... 2003-037520

(51) Int. Cl.[7] ..... H01R 13/514
(52) U.S. Cl. ..... 439/752; 439/595
(58) Field of Search ..... 439/752, 595, 439/744, 871

(56) References Cited

U.S. PATENT DOCUMENTS

| | | | | |
|---|---|---|---|---|
| 6,139,375 | A | 10/2000 | Konoya et al. | |
| 6,368,164 | B1 | 4/2002 | Nakamura | |
| 6,599,154 | B2 | 7/2003 | Sakurai et al. | |
| 6,692,302 | B1 * | 2/2004 | Tsuji et al. | 439/595 |
| 6,733,346 | B2 * | 5/2004 | Tsuji et al. | 439/748 |
| 6,769,934 | B2 * | 8/2004 | Nakamura et al. | 439/595 |

FOREIGN PATENT DOCUMENTS

| | | |
|---|---|---|
| JP | 11-167949 | 6/1999 |
| JP | 2000-223238 | 8/2000 |
| JP | 2000-348808 | 12/2000 |
| JP | 2002-305055 | 10/2002 |

* cited by examiner

*Primary Examiner*—P. Austin Bradley
*Assistant Examiner*—Phuongchi Nguyen
(74) *Attorney, Agent, or Firm*—Gerald E. Hespos; Anthony J. Casella

(57) ABSTRACT

A connector includes a housing (130) with a cavity (131) and a lock (133) that is resiliently deformable along a deformation direction (DD). A terminal fitting (110) is insertable into and withdrawable from the cavity (131) along inserting and withdrawing directions (IWD) and is configured to be locked by the lock (133). A jig (160) can be slid linearly into a jig insertion space (148) between the terminal fitting (110) and the lock (133) for disengaging the lock (133) from the terminal fitting (110).

7 Claims, 17 Drawing Sheets

S 6899EU 10/17

CONNECTOR, A CONNECTOR ASSEMBLY, A JIG, AND A METHOD FOR WITHDRAWING A TERMINAL IN A CONNECTOR

This application is a divisional of U.S. patent application Ser. No. 10/757,699, filed Jan. 14, 2004.

BACKGROUND OF THE INVENTION

1. Field of the Invention

The invention relates to a connector. Furthermore, the invention relates to a jig and a method for withdrawing a terminal in a connector.

2. Description of the Related Art

FIG. 12 shows a male connector with a male housing 100 and female connector with a female housing 101. The male housing 100 has a receptacle 102 for accommodating the female housing 101. The female housing 101 has a retainer 103 for locking unillustrated terminal fittings. The retainer 103 can be mounted at a partial locking position, where the retainer 103 is assembled lightly with the female housing 101, and at a full locking position, where the retainer 103 is assembled deeply in the female housing 101 to lock the terminal fittings.

Housing ribs 104A, 104B project up or down from opposite left and right ends of upper and lower outer surfaces 105 of the female housing 101. The projecting ends of the housing ribs 104B on the lower surface are substantially flush with the bottom surface of the retainer 103 when the retainer 103 is at the partial locking position in the female housing 101 (see FIG. 13).

Connectors to be installed in a spatially limited place, such as an engine compartment of an automotive vehicle, sometimes must be small and thin to take up a small space. Under such a circumstance, receptacles of male housings may be made wide and short. Additionally, there has been ongoing progress in recent years to make terminal fittings and housings smaller and to have more contacts. Thus, the receptacle 102 has been made gradually thinner and has become easier to deform. Accordingly, the female housing 101 may undesirably fit into the receptacle 102, as shown in FIG. 13, even if the retainer 103 is at the partial locking position. This problem is likely to occur if the housings 100, 101 are connected in a visually obscured place, such as inside a control panel. In these situations, the connecting operation depends on the feeling of hands, and it is difficult to confirm by hand whether the retainer 103 is at the partial locking position or at the full locking position.

Japanese Unexamined Patent Publication No. 2000-223238 discloses a connector with a housing and a cavity in the housing. A terminal fitting is inserted into the cavity and is locked by a resiliently deflectable lock. A jig is used to detach the terminal fitting from the housing. The jig has an unlocking portion for deforming the lock and a terminal pushing portion for pushing the terminal fitting backward. The terminal pushing portion is formed integrally on a jig main body. However, the unlocking portion is separate from the jig main body and is assembled with the jig main body via a spring to move forward and back. The jig is inserted toward the lock and the unlocking portion of the jig deforms the lock to cancel the locked state of the terminal fitting. The terminal pushing portion then moves forward relative to the unlocking portion and pushes the terminal fitting out backward.

However, the above-described jig has a large number of parts, and hence has a complicated construction and a high cost.

The present invention was developed in view of the above problem and an object thereof is to provide a connector capable of preventing a housing from being erroneously connected with a mating housing when the housing and a retainer are located at a first position.

SUMMARY OF THE INVENTION

The invention relates to a connector with a housing for accommodating at least one terminal fitting. A retainer can be fit in the housing at a first position or a second position. The retainer at the first position is assembled lightly with the housing to permit the insertion and withdrawal of the terminal fittings. The retainer at the second position is assembled deeply with the housing to lock the terminal fittings in the housing. At least one housing rib projects from an outer surface of the housing and can fit into an accommodating groove in a receptacle of a mating housing. The retainer includes at least one retainer rib that projects out beyond the housing rib when the retainer is at the first position. However, the retainer rib does not project beyond the housing rib when the retainer is at the second position. The retainer rib aligns substantially with the housing rib along a connecting direction of the two housings.

The connector is assembled by inserting the retainer to the first locking position in the housing and then mounting the terminal fittings into the housing. The retainer then is pushed to the second locking position. The housings then are connected so that the housing rib fits into the accommodating groove in the receptacle of the mating housing.

An attempt could be made to connect the housings while the retainer is at the first locking position or between the first and second locking positions. In this situation, the retainer rib projects out beyond the housing rib and hence the retainer rib cannot fit into the accommodating groove. Thus, an erroneous assembling of the two housings can be avoided while the retainer is at the first locking position.

The numbers of the housing rib and the retainer rib do not matter and may be one, two or more.

Moreover, it does not matter whether the connector is a female connector or a male connector.

The projecting end of the retainer rib preferably is flush with the housing rib when the retainer is at the full locking position. Thus, the housing rib and the retainer rib smoothly guide the connection of the housings.

The housing may have at least one auxiliary housing rib on an outer surface different from the surface through which the retainer is to be mounted.

Front ends of the housing rib and the auxiliary housing rib preferably are at a substantially same position along the connecting direction.

The housing ribs preferably prevent the housing from being fit into the receptacle of the mating housing while forcibly deforming the receptacle.

The invention also relates to a connector assembly comprising the above-described connector and a mating connector.

The invention also relates to a connector with a housing that has at least one cavity into and from which a terminal fitting can be inserted and withdrawn. The housing has at least one lock for locking the terminal fitting inserted into the cavity. A jig insertion space is defined between the terminal fitting and the lock and a disengaging portion of a jig is insertable into the jig insertion space substantially along inserting and withdrawing directions of the terminal fitting. The terminal fitting has a pushable projection that projects toward the lock and that is pushable by the disengaging portion. A dimension of the jig insertion space along a deforming direction of the lock is smaller than a dimension of the disengaging portion of the jig along the deforming direction of the lock. A difference between the dimension of the jig insertion space and the dimension of the disengaging portion may equal a displacement of the lock needed to cancel the locked state of the terminal fitting.

The terminal fitting can be disengaged from the lock by inserting the disengaging portion of the jig into the jig insertion space from the front and substantially along the insertion and withdrawal directions. A dimension of the jig insertion space along a deforming direction of the lock is less than a dimension of the disengaging portion along the deforming direction of the lock. Additionally, the difference between the dimension of the jig insertion space and the dimension of the disengaging portion substantially equals a displacement of the lock necessary to cancel the locked state of the terminal fitting. Thus, insertion of the disengaging portion to a specified depth resiliently deforms the lock until the locked state of the terminal fitting is canceled. The disengaging portion then engages the pushable projection that projects from the terminal fitting and pushes unlocked terminal fitting back. Accordingly, one disengaging portion resiliently deforms the lock and moves the female terminal fitting back. Thus, the jig is simple and the female terminal fitting can be detached more efficiently than with the prior art jig where these two functions are performed by two special parts.

An introducing part of the lock for introducing the disengaging portion preferably has a slanted guiding surface that is inclined to gradually decrease the dimension of the jig insertion space along the deforming direction of the lock toward the back. Thus, the disengaging portion can be inserted more smoothly into the jig insertion space.

The pushable projection preferably is widened so that a projecting distance thereof increases gradually toward the back, and a slanted guiding surface is formed on an outer surface of the pushable projection for guiding the disengaging portion in an unlocking direction of the lock by sliding in contact with the disengaging portion. Thus, the locked state of the terminal fitting by the lock can be canceled more securely.

The pushable projection preferably is engageable with the lock for locking the terminal fitting. Thus, a locking force for locking the terminal fitting in the locked state can be improved.

The invention also relates to a method for detaching a terminal fitting locked by a lock in a cavity formed in a connector housing. The method comprises inserting a disengaging portion of a jig into a jig insertion space between the terminal fitting and the lock for deforming the lock in an unlocking direction and for canceling a locked state of the terminal fitting. The method then comprises pushing the disengaging portion against a pushable projection of the terminal fitting to move the unlocked terminal fitting backward.

These and other features and advantages of the invention will become more apparent upon reading the following description of preferred embodiments and the drawings. Even though embodiments are separately described, single features may be combined to additional embodiments.

DETAILED DESCRIPTION OF THE PREFERRED EMBODIMENTS

Figure 1:
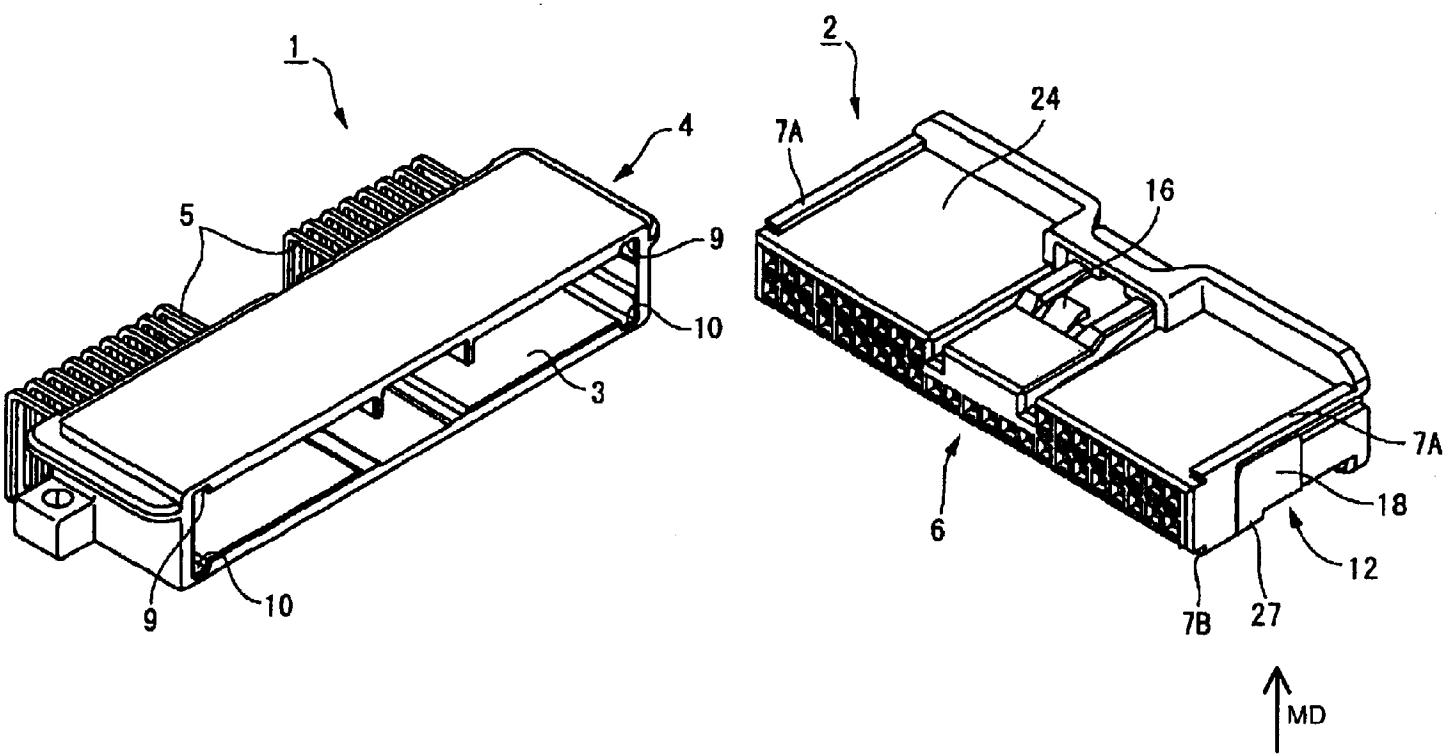
FIG. 1 is a perspective view showing one embodiment of the invention before a pair of male and female connectors are connected.
Figure 2:
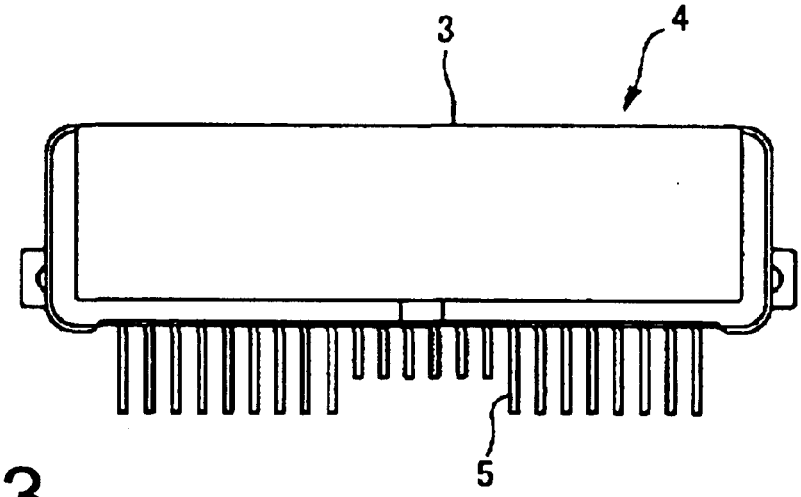
FIG. 2 is a plan view of the male connector.
Figure 3:
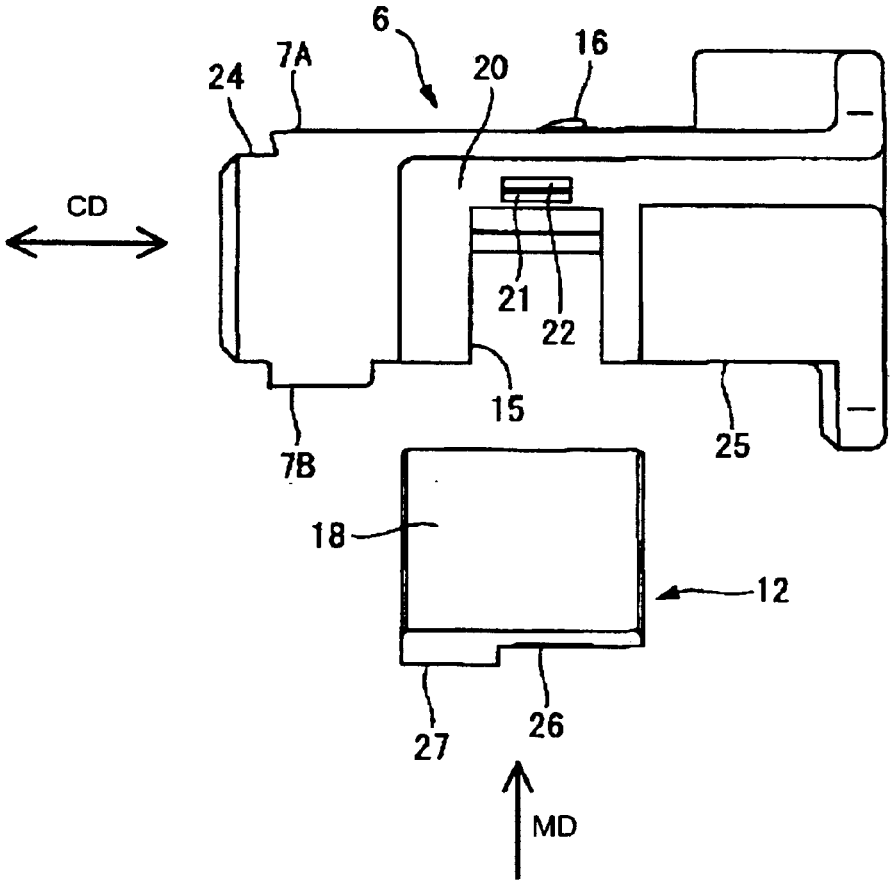
FIG. 3 is a side view showing a state before the female housing and the retainer are assembled.

A first embodiment of the invention is described with reference to FIGS. 1 to 11. FIG. 1 shows male and female connectors 1, 2 connectable with each other along a connecting direction CD. In the following description, sides (those shown in FIG. 1) of the two connectors 1, 2 to be connected are referred to as the front sides. The male connector 1 shown has a male housing 4 formed with a receptacle 3 and male terminal fittings 5 made of electrically conductive members.

Figure 9:
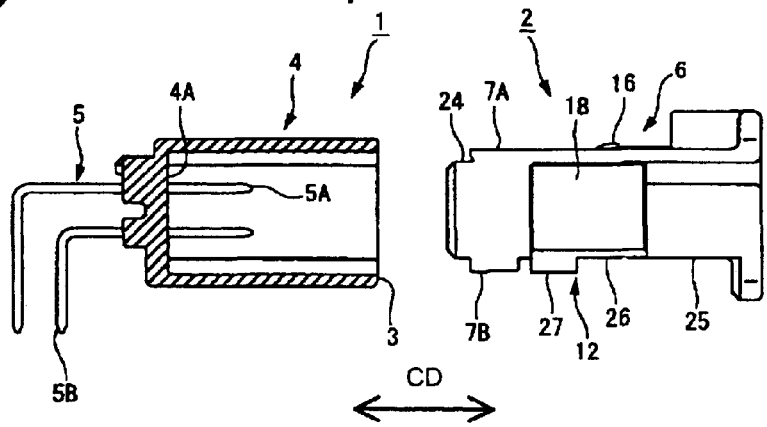
FIG. 9 is a side view (with the male connector shown in section) showing a state before the male and female connectors are connected after the female housing and the retainer are assembled to the full locking position.

Each male terminal fitting 5 is a substantially rectangular column with an intermediate portion inserted through and fixed in a rear wall 4*a* of the male housing 4 (see also FIG. 9). Each male terminal fitting 5 has a coupling end 5A and fixed end 5B. The coupling end 5A is accommodated in the receptacle 3. The fixed end 5B extends back from the rear wall 4A and is bent down substantially normal to the coupling end 5A. Although not shown, the male connector 1 is to be fixed to a plate, such as a printed circuit board, electric device, panel, or the like. The fixed ends 5B are inserted though holes in the plate, and the male connector 1 is fixed to the plate, for example, by soldering, resistance welding, ultrasonic welding, clamping or the like.

The male housing 4 is made e.g. of a synthetic resin into a substantially rectangular parallelepiped. The receptacle 3 of the male housing 4 is open forward and a female housing 6 can be accommodated therein. Accommodating grooves 9, 10 are formed at the left and right ends of the upper and lower sides of the receptacle 3.

The female connector 2 has a female housing 6 in which female terminal fittings 11 are accommodated. Additionally, a retainer 12 is mountable in the female housing 6 along a mounting direction MD. The female housing 6 is slightly smaller than the receptacle 3, and terminal cavities 13 (see also FIGS. 7 and 8) are provided in the female housing 6 for receiving the female terminal fittings 11. A resilient lock 16 is provided on substantially the middle of the upper surface of the female housing 6 for locking the connectors 1, 2 together. Housing ribs 7A, 7B project at the left and right ends of the upper and lower outer surfaces 24, 25 of the female housing 6 and can fit into the accommodating grooves 9, 10 of the male housing 4. The housing ribs 7A on the upper outer surface 24 extend longitudinally along the connecting direction CD from a position slightly behind the front end of the female housing 6 substantially to the rear end of the female housing 6. On the other hand, the housing ribs 7B on the lower outer surface 25 extend only at the front part of the female housing 6 from substantially the same positions as the front ends of the housing ribs 7A on the upper outer surface 24.

A connection hole 13A is formed at the front of each cavity 13 for receiving the coupling end 5A of the corresponding male terminal fitting 5. A resilient lock 14 is provided inside the cavity 13 and is engageable with the female terminal fitting 11. The retainer mount hole 15 is open substantially in the middle of the bottom surface of the female housing 6 and communicates with the cavities 13. The retainer mount hole 15 extends along the widthwise direction of the female housing 6, and the retainer 12 is mountable therein.

The retainer 12 is engageable with the female housing 6 at a partial locking position, where the retainer 12 is assembled lightly with the female housing 6, and a full locking position, where the retainer 12 is assembled deeply with the female housing 6. The retainer 12 has locking sections 17 that engage the female terminal fittings 11. The retainer 12 also has two locking pieces 18 that engage with the left and right surfaces of the female housing 6 for holding the female housing from substantially opposite directions. Each locking piece 18 is slightly resiliently deformable outward in an unlocking direction and has a locking recess 19 that contacts a left or right outer wall surface 20 of the female housing 6 (see FIG. 4). Each locking recess 19 is engageable with one of a pair of locking projections 21, 22 on the corresponding left or right outer wall surface 20 of the female housing 6.

Figure 4:
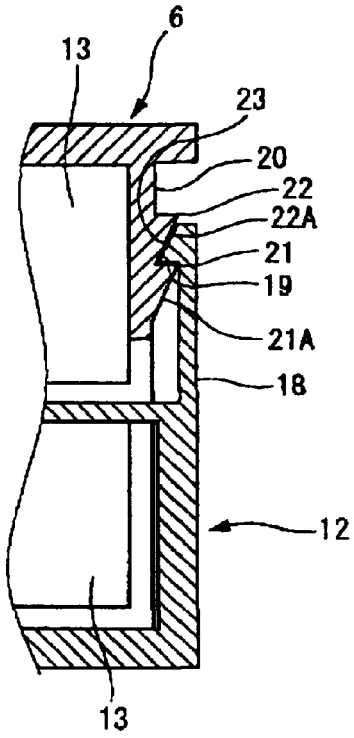
FIG. 4 is an enlarged section showing a locked portion of the female housing and the retainer.
Figure 5:
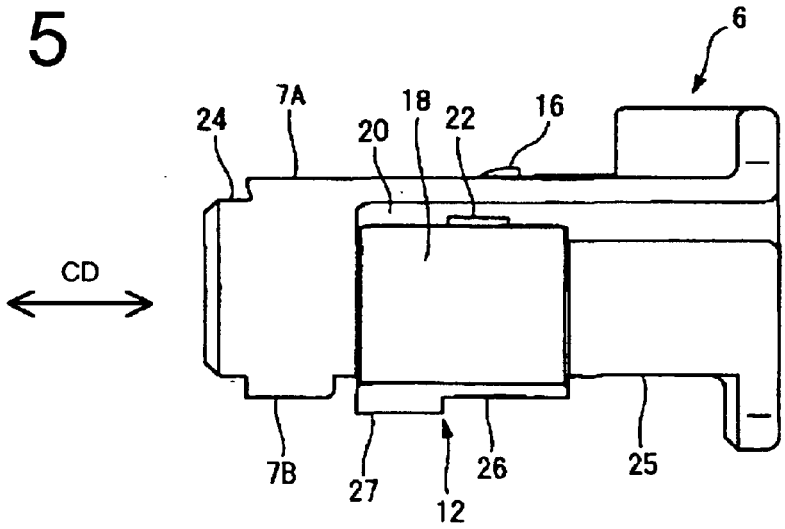
FIG. 5 is a side view showing a state where the female housing and the retainer are assembled at a partial locking position.
Figure 7:
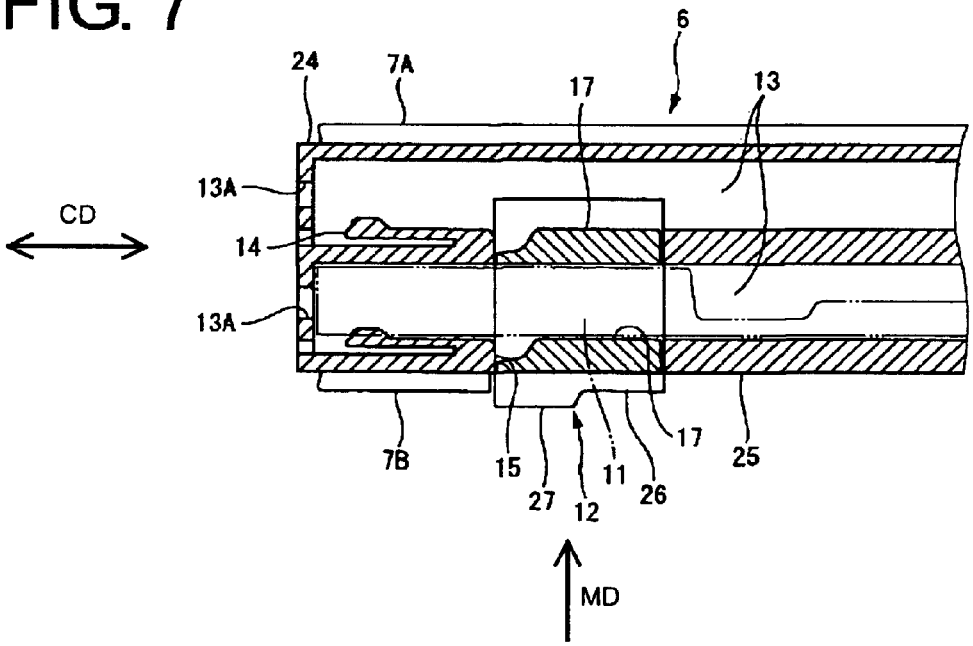
FIG. 7 is a side view in section showing a state inside terminal cavities with the female housing and the retainer at the partial locking position.

Two locking projections 21, 22 project on each of the left and right outer wall surfaces 20 and are spaced apart vertically along a mounting direction MD of the retainer. The locking recesses 19 engage the lower locking projections 21 to hold the retainer 12 at the partial locking position in the female housing 6, as shown in FIGS. 4, 5 and 7. The leading ends of the locking sections 17 of the retainer 12 are retracted from or flush with the corresponding cavities 13 when the retainer 12 is at the partial locking position, as shown in FIG. 7. Thus, the female terminal fittings 11 can be inserted into and withdrawn from the cavities 13 when the retainer is at the partial locking position.

Figure 6:
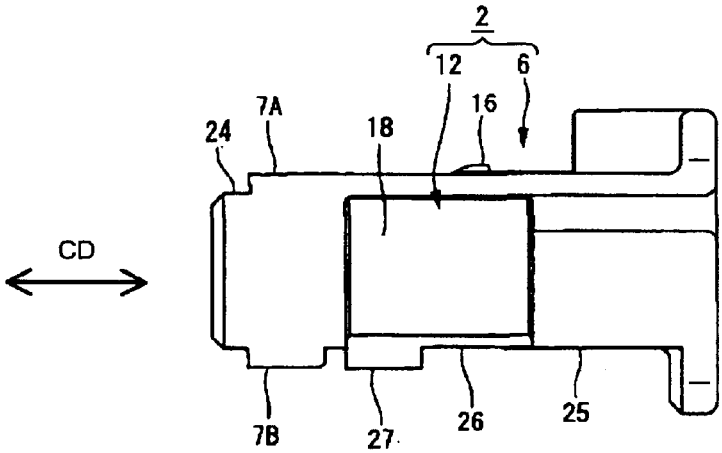
FIG. 6 is a side view showing a state where the female housing and the retainer are located at a full locking position.
Figure 8:
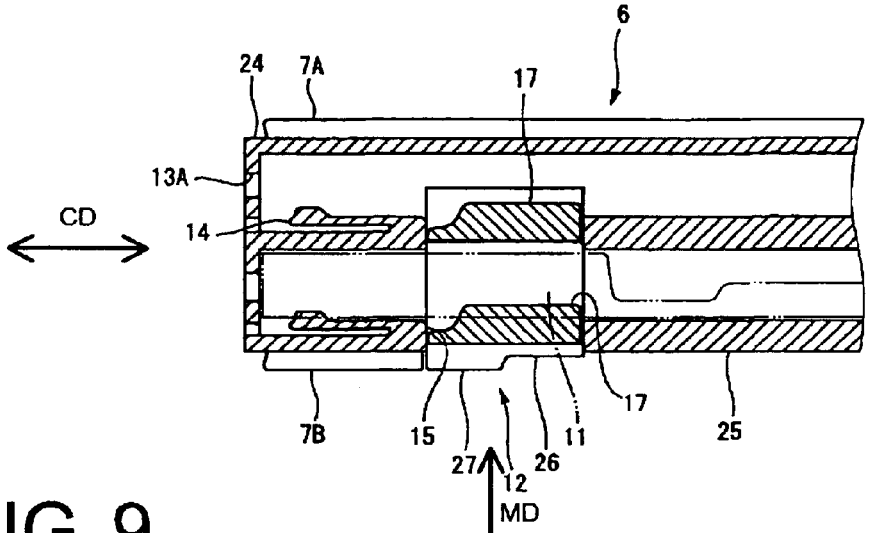
FIG. 8 is a side view in section showing a state inside terminal cavities with the female housing and the retainer at the full locking position.

The female housing 6 and the retainer 12 are assembled to the full locking position shown in FIGS. 6 and 8 by engaging the locking recesses 19 with the upper locking projections 22. At this full locking position, the locking sections 17 project into the cavities 13 from below, as shown in FIG. 8. Thus, the female terminal fittings 11 are locked in the cavities 13 so as not to come out. Guiding surfaces 21A, 22A are formed on the lower sides of the locking projections 21, 22. On the other hand, guiding surfaces 23 are formed on the inner sides of the upper ends of the locking pieces 18 for contacting the guiding surfaces 21A, 22A. The surface contact of the guiding surfaces (21A, 23 or 22A, 23) moves the locking pieces 18 smoothly and resiliently over the locking projections 21, 22 and into engagement with the locking projections 21, 22. The upper surfaces of the locking projections 21, 22 extend substantially normal to the outer wall surfaces 20 to strengthen the engaging forces of the respective locking projections 21, 22 and the locking recesses 19.

Retainer ribs 27 project from a bottom surface 26 of the retainer 12 substantially in the same direction as the housing ribs 7B and at positions substantially aligned with the housing ribs 7B along the connecting direction CD of the two housings 4, 6. The retainer ribs 27 are provided at a front portion of the retainer 12. The projecting ends of the retainer ribs 27 are more outward (below in FIG. 5) than the housing ribs 7B when the retainer 12 is engaged with the female housing 6 at the partial locking position (see FIG. 5). However, the projecting ends of the retainer ribs 27 substantially align with the projecting ends of the housing ribs 7B when the retainer 12 is engaged with the female housing 6 at the full locking position (see FIG. 6). Additionally, the forward ends retainer ribs 27 substantially abut the forward ends of housing ribs 7B when the retainer 12 is at the full locking position. Thus, the retainer ribs 27 reinforce the housing ribs 7B and help to prevent inverted or other improper insertion into a mating housing, as explained herein.

Figure 10:
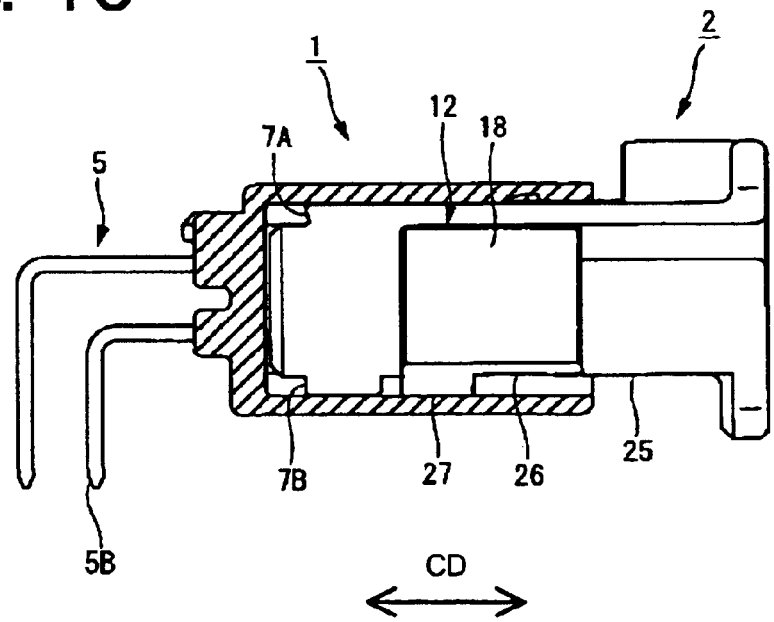
FIG. 10 is a side view (with the male connector shown in section) showing a state before the male and female connectors are connected after the female housing and the retainer are assembled to the full locking position.

The female connector 2 is assembled by mounting the retainer 12 in the mounting direction MD to the partial locking position in the female housing 6. The female terminal fittings 11 then are mounted into the cavities 13 and are locked by the locks 14. The retainer 12 then is pushed in the mounting direction MD to the full locking position to lock the female terminal fittings 11 redundantly. As a result, the projecting ends of the retainer ribs 27 are at the same projecting position as the projecting ends of the housing ribs 7B and align with the housing ribs 7B along the connecting direction CD of the housings 4, 6. Thus, the connecting operation of the housings 4, 6 progresses while the ribs 7A, 7B and 27 fit into the accommodating grooves 9, 10 in the receptacle 3 of the male housing 4, as shown in FIGS. 9 and 10.

Figure 11:
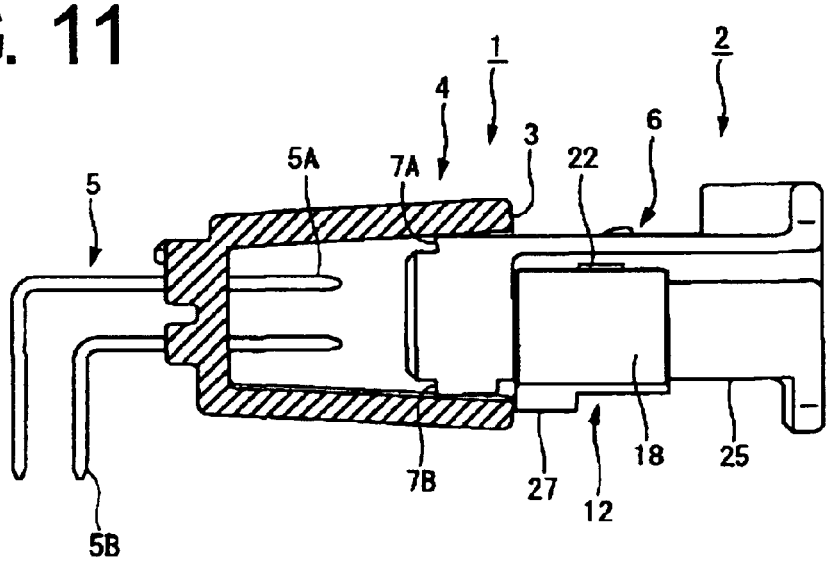
FIG. 11 is a side view (with the male connector shown in section) showing an attempt to connect the male and female connectors with the female housing and the retainer at the partial locking position.
Figure 12:
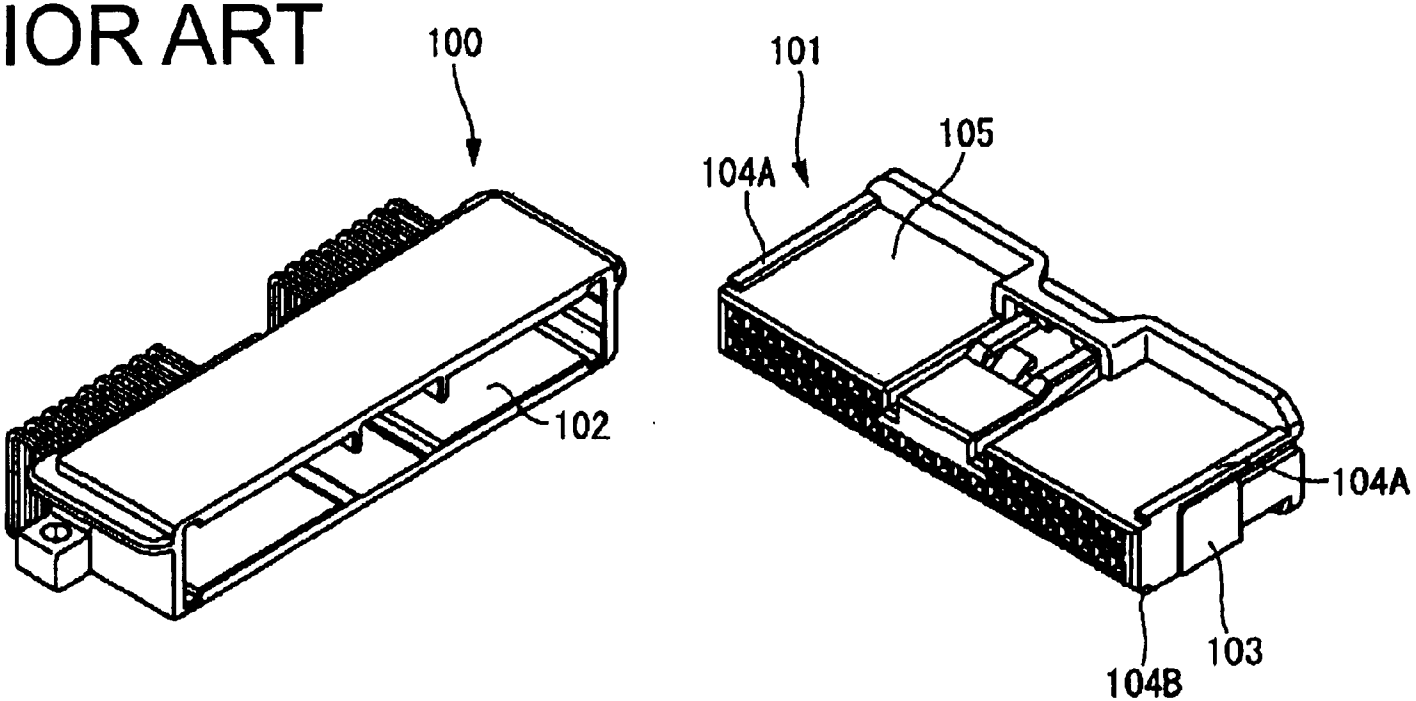
FIG. 12 PRIOR ART
FIG. 12 is a perspective view showing a pair of male and female connectors of prior art.
Figure 13:
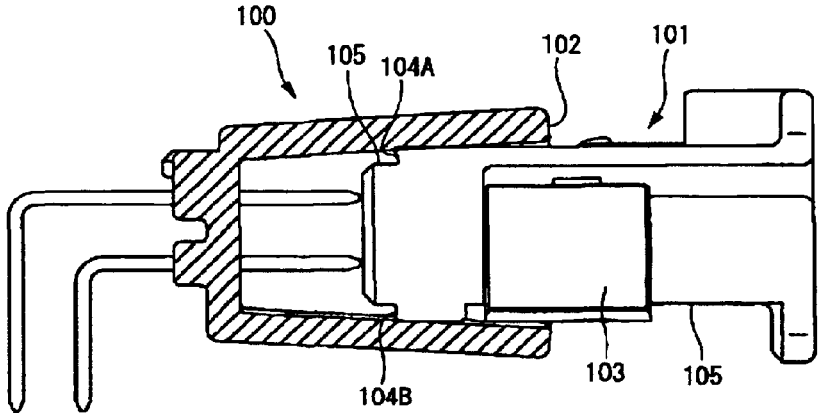
FIG. 13 PRIOR ART
FIG. 13 is a side view (with the male connector shown in section) showing a state where an attempt is made to connect the male and female connectors in the prior art with a female housing and a retainer assembled at a partial locking position.

An attempt could be made to connect the two housings 4, 6 with the retainer 12 at the partial locking position or at a position between the partial and full locking positions. Thus, the retainer ribs 27 project more outward than the housing rib 7B. However, as shown in FIG. 11, the female housing 6 cannot be inserted deeply into the receptacle 3 because the retainer ribs 27 contact the front edge of the receptacle 3. Accordingly, erroneous assembly of the housings 4, 6 is avoided. Therefore, the partial assembling of the retainer 12 is detected and damage caused by interference of the female housing 6 and the male terminal fittings 5 is prevented.

Further, the retainer ribs 27 are at substantially the same projecting positions as the housing ribs 7B along the connecting direction of the two housings 4, 6 when the female housing 6 and the retainer 12 are assembled to the full locking position. Thus, the housing ribs 7A, 7B and the retainer ribs 27 smoothly guide the connecting operation of the two housings 4, 6.

The ribs 7A, 7B have a projecting distance that exceeds the corresponding inner dimension of the receptacle 3 in positions different from the accommodating grooves 9, 10. Accordingly, the ribs 7A, 7B prevent an improperly oriented female housing 6 from deforming the receptacle 3 of the male housing 4 and being inserted forcibly into the male housing 4. The retainer ribs 27 also substantially abut the housing ribs 7B. Thus, the retainer ribs 27 reinforce the housing ribs 7B, especially when the housing ribs 7B prevent the forcible insertion of an improperly oriented female housing 6

Another embodiment of the invention is illustrated in FIGS. 14 to 22. This embodiment relates to a connector with female terminal fittings 110 and a female housing 130 for accommodating the female terminal fittings 110. A jig 160 also is provided for detaching the female terminal fitting 110 from the female housing 130. In the following description, inserting and withdrawing directions IWD of the female terminal fittings 110 into and from the female housing 130 are referred to as the forward direction and backward directions, respectively, and reference is made to all the FIGS. 14 to 22 except FIG. 15 concerning the vertical direction.

Figure 14:
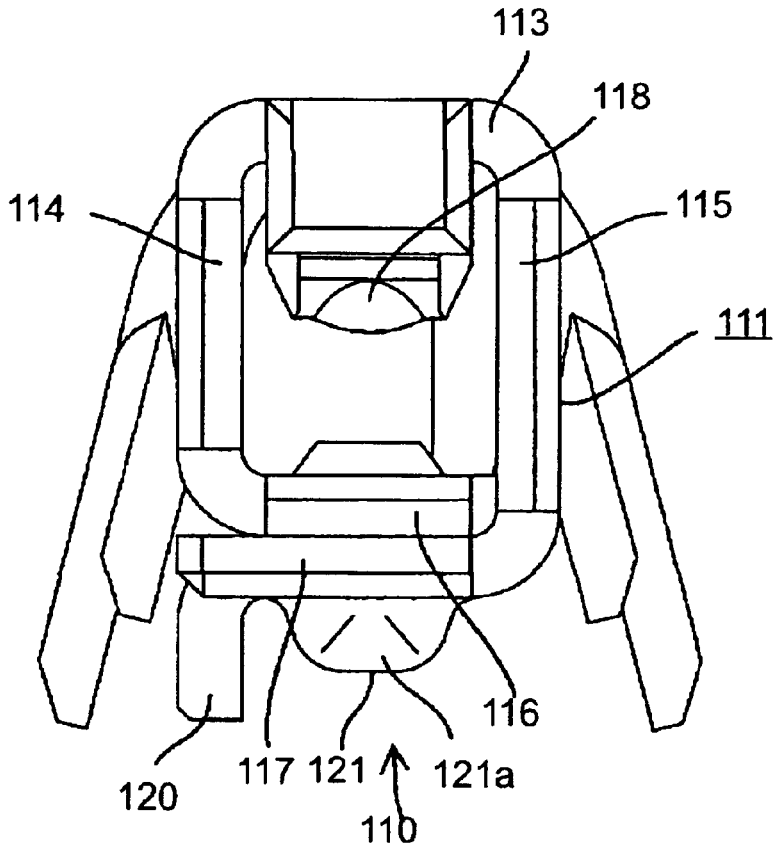
FIG. 14 is a front view of a female terminal fitting according to one further preferred embodiment of the invention.
Figure 15:
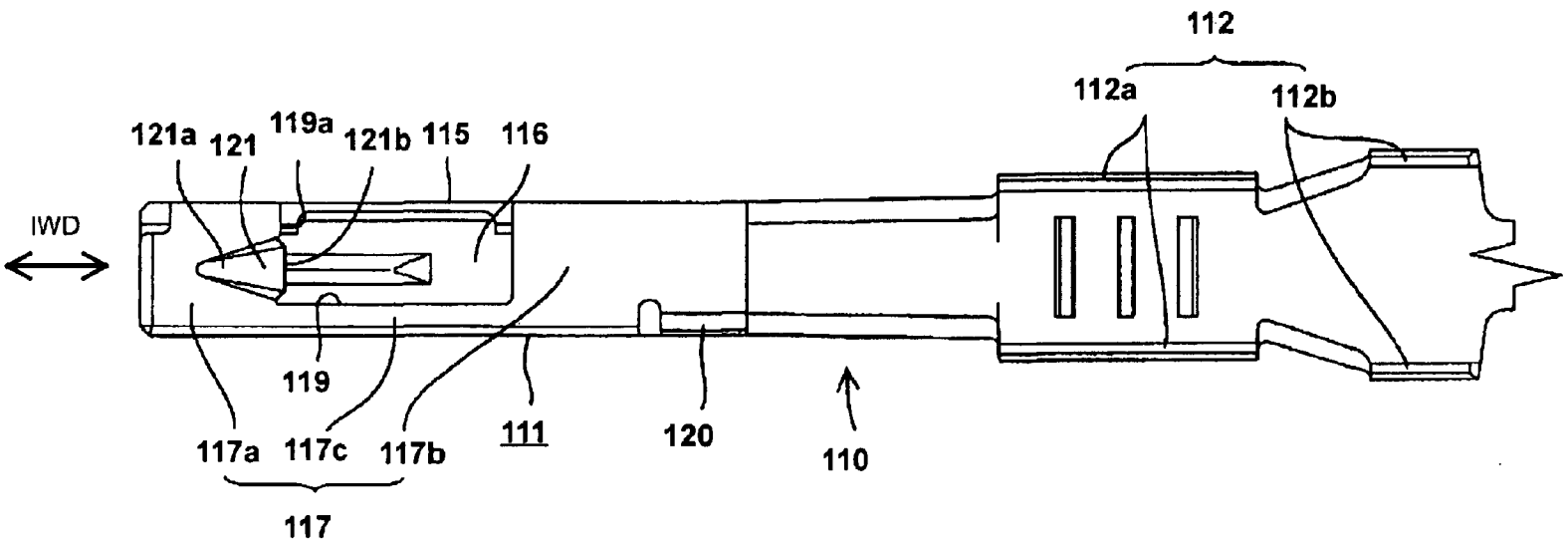
FIG. 15 is a bottom view of the female terminal fitting.
Figure 17:
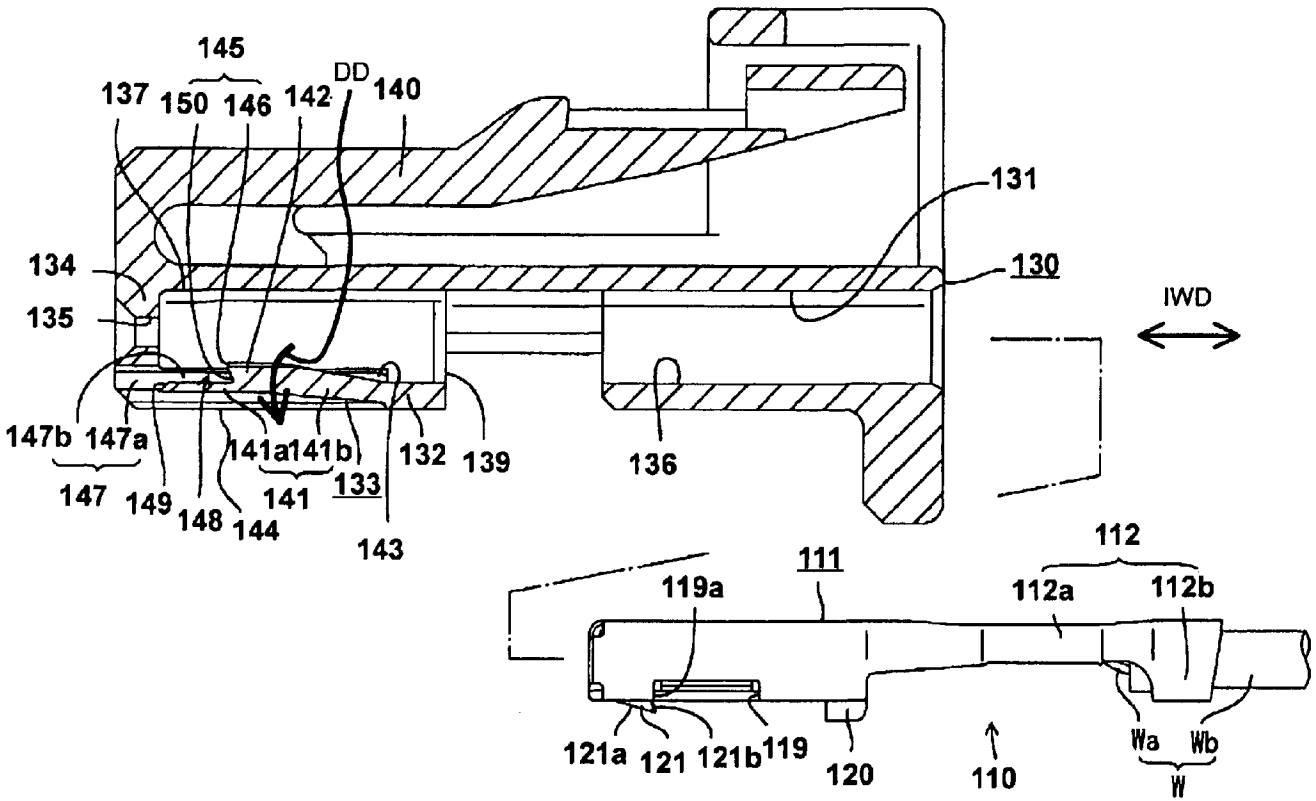
FIG. 17 is a side view in section showing the female terminal fitting and the female housing.

Each female terminal fitting 110 is formed by bending, folding and/or embossing a conductive metal plate that has been stamped or cut into a specified shape. As shown in FIGS. 14, 15 and 17, the female terminal fitting 110 has a substantially rectangular tubular main body 111 with open front and rear ends, and a barrel 112 configured to be crimped, folded or bent into connection with an end of a wire W. The main portion 111 and the barrel 112 are arranged one after the other. The barrel 112 has a pair of front crimping pieces 112*a* for connection with a core Wa of a wire W and a pair of rear crimping pieces 112*b* for connection with a coated portion Wb of the wire W.

The main body 111 has a bottom wall 113 that extends along forward and backward directions. Left and right side walls 114, 115 extend up from the opposite sides of the bottom wall 113. A ceiling wall 116 projects from the projecting end of the left side wall 114 of FIG. 14 to face the bottom wall 113, and an outer wall 117 projects from the right side wall 115 of FIG. 14 and is placed on the outer side of the ceiling wall 116. A resilient contact piece 118 is provided in the main body 111 for resiliently contacting a tab of an unillustrated mating male terminal fitting.

A longitudinal middle portion of the outer wall 117 is cut away by more than about half, and preferably over ¾, of the entire width of the outer wall 117 to form a cut-away portion 119. The cut-away portion 119 leaves a small margin at the side of the outer wall 117 toward the sidewall 114. Thus, the outer wall 117 has front and rear portions 117*a* and 117*b* with projecting ends coupled by a reinforcing piece 117*c*. A lock 133 inside the female housing 130 enters the cut-away portion 119 and engages a cut end face 119*a* at the front side of the cut-away portion 119 when the female terminal fitting 110 is inserted into the female housing 130. A stabilizer 120 projects down at the rear end of the projecting end of the rear portion 117*b* of the outer wall 117.

The end of the front portion 117*a* of the outer wall 117 at the front of the cut-away portion 119 is embossed to project out and down towards the lock 133 to form a pushable projection 121. The pushable projection 121 is substantially in the widthwise middle of the outer wall 117 and is substantially a pyramid with a vertex at its front end. Thus, the pushable projection 121 has a gradually increasing projecting distance from the outer wall 117 towards the back. Outer surfaces of the pushable projection 121 include two side surfaces facing laterally and a bottom surface facing down towards the lock 133. A guiding slanted surface 121*a* of the pushable projection 121 is sloped out and down towards the back. A rear edge 121*b* of the pushable projection 121 is continuous with the cut end face 119*a* at the front end of the cut-away portion 119 for engaging the lock 133. The rear edge 121*b* of the pushable projection 121 is sloped up to the back to overhang with respect to the outer wall 117.

Figure 16:
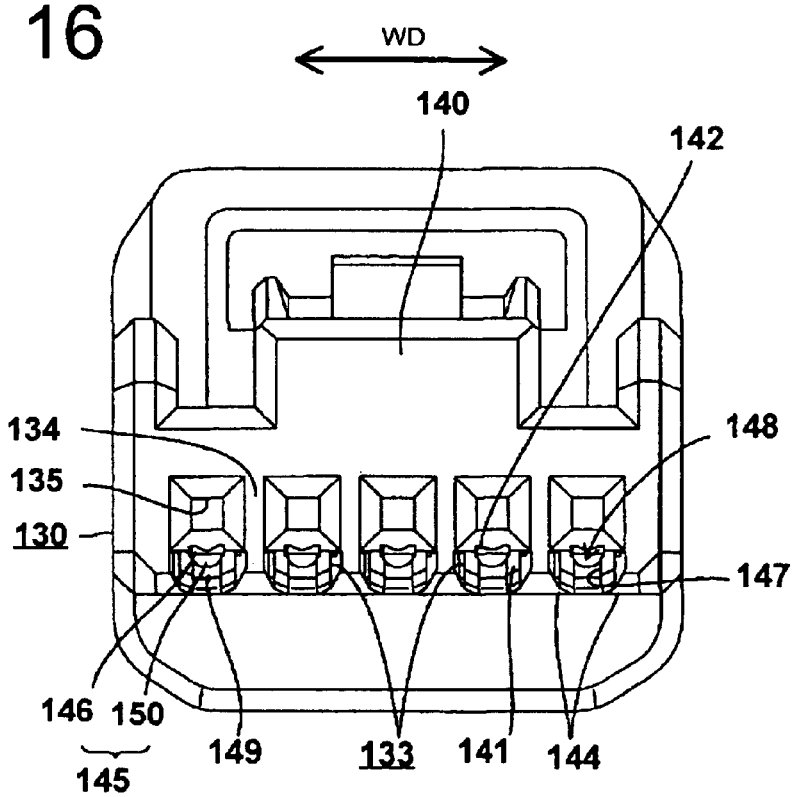
FIG. 16 is a front view of a female housing.

The female housing 130 is made e.g. of a synthetic resin and defines a block, as shown in FIGS. 16 and 17, for engaging an unillustrated male housing. Cavities 131 are arranged along a widthwise direction WD in the female housing 130 and receive the female terminal fittings 110 inserted from behind along the insertion and withdrawal direction IWD. The female terminal fittings 110 are locked in the cavities 131 by the locks 133 at bottom walls 132 of the cavities 131 and are supported at their front-limit positions by a front wall 134 of the female housing 130. The front wall 134 has tab insertion holes 135 for permitting entry of tabs of the mating male terminal fittings into the cavities 131. Substantially conical tab guiding surfaces are formed over substantially the entire periphery at the front edges of the tab insertion holes 135.

A projection-introducing groove 136 is formed in a substantially widthwise middle of the bottom wall 132 of each cavity 131 and opens rearward along the insertion and withdrawal direction IWD for receiving the pushable projection 121. The projection-introducing groove 136 is formed continuously in the lock 133. Further, a stabilizer-introducing groove (not shown) is formed in the bottom wall 132 at one side of the projection-introducing groove 136 for receiving the stabilizer 120.

The height of the cavities 131 slightly exceeds the height of the main portions 111 including the pushable projections 121. A bulge 137 slants in towards the lock 133 at the front end of the upper surface of each cavity 131 and extends over substantially the entire width of the cavity 131. The bulge 137 pushes the female terminal fitting 110 towards the lock 133 to increase a depth of engagement with the lock 133. Conversely, the female terminal fitting 110 escapes into an escape space 138 behind the bulge 137 between the female terminal fitting 110 and the upper surface of the cavity 131 to decrease the degree of engagement with the lock 133 during detachment of the female terminal fitting 110. Thus, the cavity 131 has a height at the escape space 138 that exceeds the height at the bulge 137 so that the female terminal fitting 110 can be farther from the lock 133 when in the escape recess 138.

A retainer mount hole 139 is formed in a substantially longitudinal middle of the bottom surface of the female housing 130 for receiving an unillustrated retainer inserted substantially normal to the insertion and withdrawal direction IWD. The retainer has locking sections engageable with the rear ends of the main portions 111 of the female terminal fittings 110 for locking the female terminal fittings 110 in cooperation with the locks 133. A lock arm 140 for locking the female housing 130 and the male housing together projects from the upper surface of the female housing 130.

Each lock 133 is on the bottom wall 132 of the corresponding cavity 131 before the retainer mount hole 139 and includes an arm 141 with both front and rear ends supported. A fastening projection 142 projects at a substantially widthwise middle of the upper surface of the arm 141 and into the cavity 131 for fitting into the cut-away portion 119 of the female terminal fitting 110 and for engaging the cut end face 119*a* at the front side of the cut-away portion 119.

The rear end of the arm 141 is coupled to and supported on the bottom wall 132 and the front end is coupled to and supported on the front wall 134. Additionally, the arm 141 is resiliently deformable up and down substantially normal to the insertion and withdrawal direction IWD with the front and rear ends as supports. The deformed arm 141 takes a substantially arcuate shape with its longitudinal middle at a bottommost position. A deformation space is defined below the arm 141 and has a height for permitting resilient deformation of the arm 141. A rear portion 141*b* of the arm 141 is sloped up to the front, whereas a front portion 141*a* is substantially horizontal forward and back along the insertion and withdrawal direction IWD. The projection-introducing groove 136 in the bottom wall 132 is formed continuously in the rear portion 141*b* of the arm 141, and parts of the rear portion 141*b* at the opposite sides of the projection-introducing groove 136 define supports 143 for supporting the female terminal fitting 110 from below.

The arm 141 has the bottom corners chamfered to taper toward the bottom end when viewed from the front, and two excessive deformation preventing portions 144 are provided for engaging opposite bottom corners of the arm 141 to prevent excessive deformation of the arm 141 before the arm 141 is deformed beyond its resiliency limit.

The fastening projection 142 extends over the front and rear portions 141*a*, 141*b* of the arm 141, and the rear surface of the fastening projection 142 is slanted substantially continuously with the rear portion 141*b* of the arm 141. A locking surface 145 is at the front of the fastening projection 142 and has an upper locking section 146 that is aligned substantially normal to inserting and withdrawing directions IWD of the female terminal fitting 110. The projection-introducing groove 136 in the rear portion 141*b* of the arm 141 is formed continuously in the fastening projection 142, and is recessed substantially in the widthwise middle when viewed from the front (see FIG. 16). The supports 143 are continuous at the opposite sides of the fastening projection 142.

A groove 147 is formed substantially in the widthwise middle of the upper surface of the front portion 141*a* of the arm 141 and has an open front end. A rear portion 147*b* of the groove 147 has a depth slightly larger than about half the thickness of the front portion 141*a* of the arm 141. A front portion 147*a* of the groove 147 has a depth substantially equal to the thickness of the front portion 141*a* of the arm 141. Thus, the groove 147 forks a substantially front half of the front portion 141*a* of the arm 141. The groove 147 defines a jig insertion space 148 between the female terminal fitting 110 and the lock 133. The jig 160 can be inserted into the jig insertion space 148 from the front for forcibly resiliently deforming the lock 133 in the deforming direction DD. The bottom surface of the rear portion 147*b* of the groove 147 is substantially horizontal along the insertion and withdrawal directions IWD. However, a slanted front surface 149 of the groove 147 slopes down and out to the front to reduce a distance to the bottom surface of the female terminal fitting 110 toward the back and to reduce the height of the jig insertion space 148 toward the back. The slanted surface 149 guides the insertion of the jig 160. The front end of the slanted surface 149 is at substantially the same position as or slightly before the front end of the female terminal fitting 110 inserted to a proper depth in the cavity 131. The supports 143 are coupled to the front wall 134 at the opposite sides of the rear portion 147*b* of the groove 147.

The pushable projection 121 of the female terminal fitting 110 can enter the rear end of the groove 147. The locking surface 145 has a lower locking section 150 at the rear end of the groove 147 for engaging the rear edge 121*b* of the pushable projection 121. The lower locking section 150 is substantially continuous with the upper locking section 146 of the locking surface 145, but is aligned to recede from the upper locking section 146 toward its bottom end. Thus, the lower locking section 150 is at an obtuse angle to the withdrawing direction of the female terminal fitting 110, and this angle is larger than the substantially right angle of the upper locking surface 146 to the withdrawing direction. The guiding slanted surface 121*a* of the pushable projection 121 slopes obliquely down to the front when the pushable projection 121 is in the groove 147. Accordingly, the jig 160 inserted from the front slides in contact with the guiding slanted surface 121*a* to guide the jig 160 down in the unlocking direction of the lock 133.

The jig 160 has a jig main body 161 that can be by an operator. A disengaging portion 162 projects from the leading end surface of the jig main body 161 for cooperating with the lock 133. A restricting portion 163 is coupled to the jig main body 161 and the disengaging portion 162 to restrict an insertion depth of the jig 160. The disengaging portion 162 has a substantially constant thickness T over its entire length and is reinforced by the restricting portion 163 coupled to the base end thereof. The front end of the disengaging portion 162 is slightly rounded. The restricting portion 163 engages the slanted surface 149 at the base of the forked part of the arm 141 before the leading end of the disengaging portion 162 abuts the fastening projection 142 to prevent any further insertion of the jig 160.

The height of the jig insertion space 148 as measured along the resilient deforming direction DD of the lock 133 changes as the jig insertion space 148 extends from the front side toward the rear side. First, the height A of the jig insertion space 148 at a front-end P1 of the slanted surface 149 substantially equals or slightly exceeds the thickness T of the disengaging portion 162 to facilitate the insertion of the disengaging portion 162. The height of the jig insertion space 148 is reduced gradually to B in a section from the front-end P1 to a rear-end P2 of the slanted surface 149. The height B is less than the thickness T of the disengaging portion 162. Thus, the lock 133 is pushed down by the disengaging portion 162 and is deformed resiliently. The height of the jig insertion space 148 remains substantially at B along a section from the rear-end P2 of the slanted surface 149 to a front-end P3 of the pushable projection 121. A difference between the height B and the thickness T of the disengaging portion 162 is slightly smaller than a displacement resulting from the resilient deformation of the lock 133 along the deformation direction DD necessary to cancel the locked state of the female terminal fitting 110. Accordingly, when the disengaging portion 162 reaches the position P3 of the jig insertion space 148, the lock 133 deforms resiliently only to an extent to engage slightly with the female terminal fitting 110.

The pushable projection 121 projects toward the lock 133 at more rearward positions. Thus, the height of the jig insertion space 148 is reduced gradually towards the back and reaches dimension C at a position P4 in the rear half of the front portion 141*a* of the arm 141. A difference between the height C of the jig insertion space 148 and the thickness T of the disengaging portion 162 substantially equals the displacement of the lock 133 needed to disengage the lock 133 from the female terminal fitting 110. Accordingly, the lock 133 is deformed resiliently to a position where the locked state of the female terminal fitting 110 is canceled when the disengaging portion 162 is inserted to the position P4 of the jig insertion space 148. The height of the jig insertion space 148 behind the position P4 is smaller than the dimension C. Accordingly, the difference between the height of the jig insertion space 148 behind the position P4 and the thickness T of the disengaging portion 162 exceeds the displacement of the lock 133 needed to disengage the lock 133 from the female terminal fitting 110.

The connector is assembled while the unillustrated retainer is mounted at the partial locking position in the retainer mount hole 139 of the female housing 130. Each female terminal fitting 110 is connected with the end of the wire W, as shown in FIG. 17, and is inserted into the corresponding cavity 131 from behind and along the inserting and withdrawal direction IWD. Thus, the pushable projection 121 is introduced into the projection-introducing groove 136 and the stabilizer 120 is introduced into the stabilizer-introducing groove so that the female terminal fitting 110 is inserted smoothly. The lock 133 is pressed by the pushable projection 121 when the female terminal fitting 110 is inserted to a specified depth, and the arm 141 of the lock 133 is deformed resiliently down in the deforming direction DD. The pushable projection 121 is substantially a pyramid whose vertex is located at its front end. Thus, the pushable portion 121 is introduced smoothly along the projection-introducing groove 136 to press the lock 133 smoothly.

Figure 18:
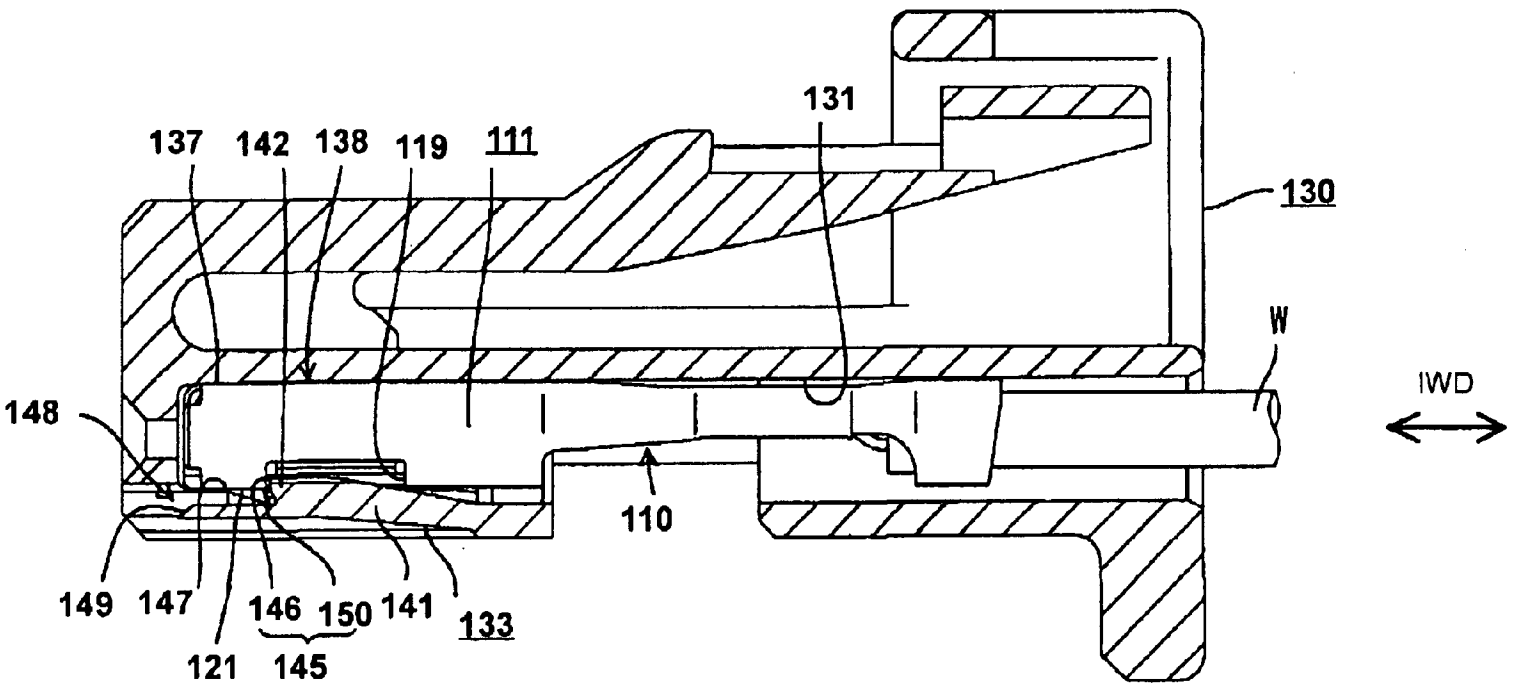
FIG. 18 is a side view in section showing a state where the female terminal fitting is inserted into a cavity.

The pushable projection 121 moves over the fastening projection 142 of the lock 133 and enters the groove 147 in front of the fastening projection 142 when the female terminal fitting 110 is inserted to the proper depth in the cavity 131. The lock 133 then is restored resiliently, as shown in FIG. 18. Simultaneously, the fastening projection 142 of the lock 133 enters the cut-away portion 119 and the upper and lower locking surfaces 146, 150 engage with the cut end face 119*a* at the front of the cut-away portion 119 and the rear edge 121*a* of the pushable projection 121. As a result, the female terminal fitting 110 is locked. The front end of the main portion 111 is pressed down by the bulge 137 on the upper surface of the cavity 131 in the process of inserting the female terminal fitting 110 and approaches the lock 133. Thus, a depth of engagement of the lock 133 with the female terminal fitting 110 is increased, thereby contributing to an improved locking force. Further, the rear edge 121*b* of the pushable projection 121 overhangs and the lower locking surface 150 overhangs at substantially the same inclination of the rear edge 121*b*. Thus, the locking force is even stronger. The retainer is moved to the full locking position after all the female terminal fittings 110 are inserted into the corresponding cavities 131 to lock the female terminal fittings 110 redundantly.

Figure 19:
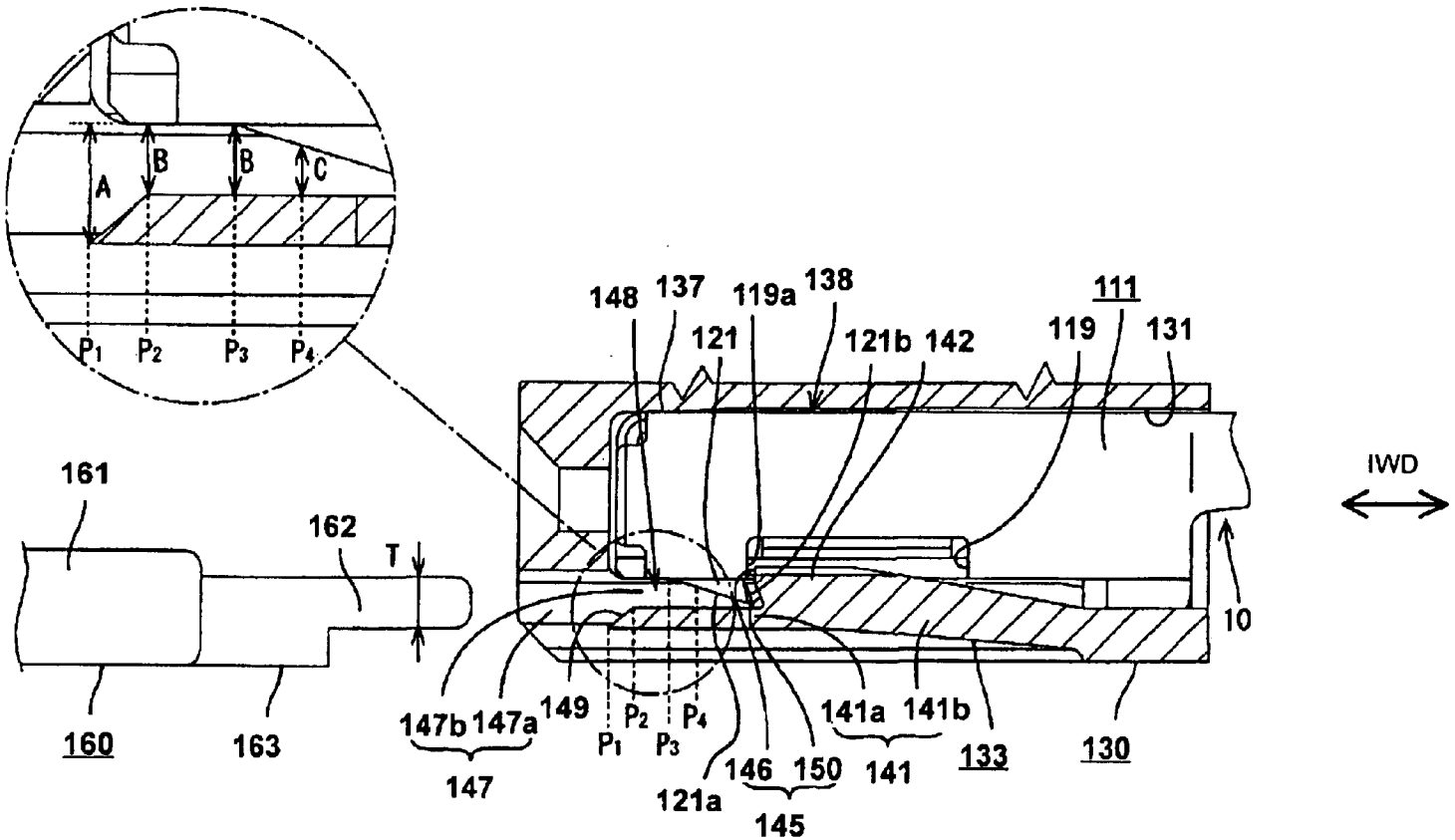
FIG. 19 is an enlarged side view in section showing a jig and the female housing having the female terminal fitting inserted therein.
Figure 20:
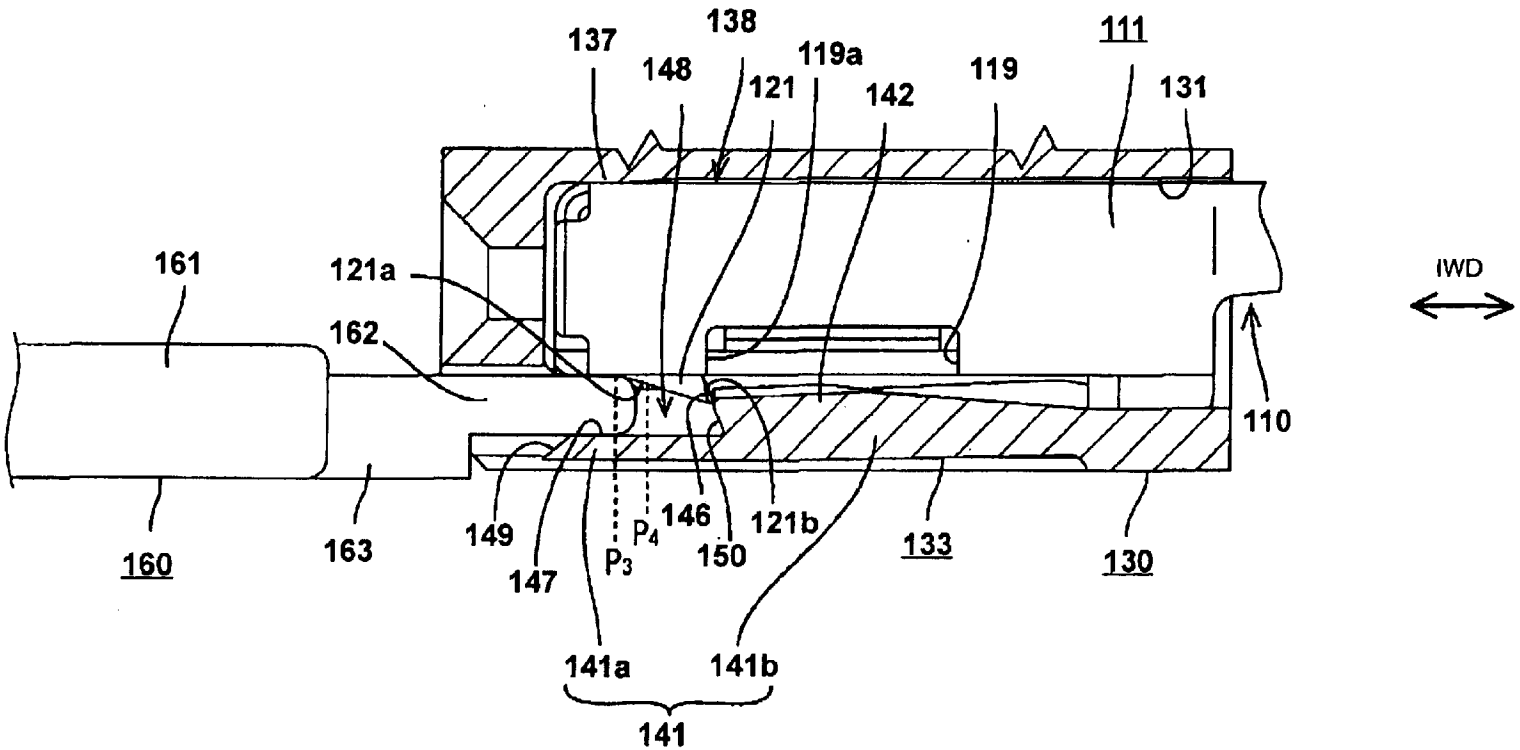
FIG. 20 is an enlarged section showing a state where a disengaging portion is located at a position P3 in a jig insertion space.

The female terminal fittings 110 may have to be detached from the female housing 130 for maintenance or other reasons. In such a case, the jig 160 is placed in front of the female housing 130 and the disengaging portion 162 is inserted into the groove 147 and into the jig insertion space 148 from the front, as shown in FIG. 19. The jig 160 is inserted so that the longitudinal axis of the jig 160 aligns with the inserting and withdrawing directions IWD of the female terminal fittings 110. The disengaging portion 162 slides smoothly in contact with the slanted surface 149 as the disengaging portion 162 is inserted from P1 to P2 in the jig insertion space 148. Thus, the disengaging portion 162 deforms the lock 133 gradually down in the deformation direction DD. The disengaging portion 162 presses a larger area of the bottom surface of the groove 147 as the disengaging portion 162 moves from P2 to P3 in the jig insertion space 148. Thus, the front portion 141*a* of the arm 141 is deformed in the deforming direction DD to take a substantially horizontal posture substantially parallel to the insertion and withdrawal directions IWD, as shown in FIG. 20. In this state, the fastening projection 142 is retracted down in the deforming direction DD from the cut-away portion 119, the upper locking surface 146 is disengaged from the cut end face 119*a* at the front side and the lower locking surface 150 is disengaged from the pushable projection 121. However, the upper locking surface 146 remains slightly engaged with the projecting end of the pushable projection 121.

Figure 21:
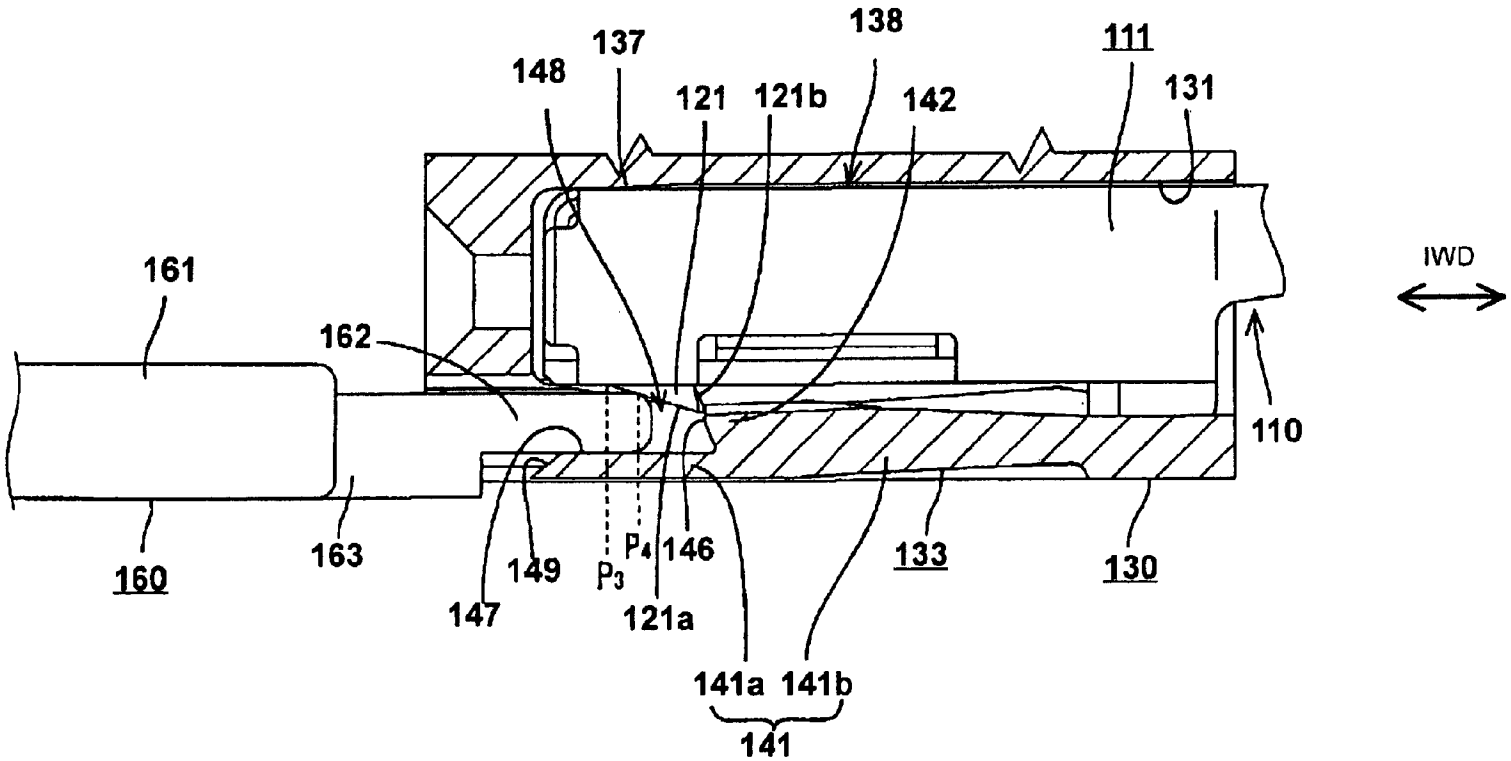
FIG. 21 is an enlarged section showing a state where the disengaging portion is located at a position P4 in the jig insertion space.
Figure 22:
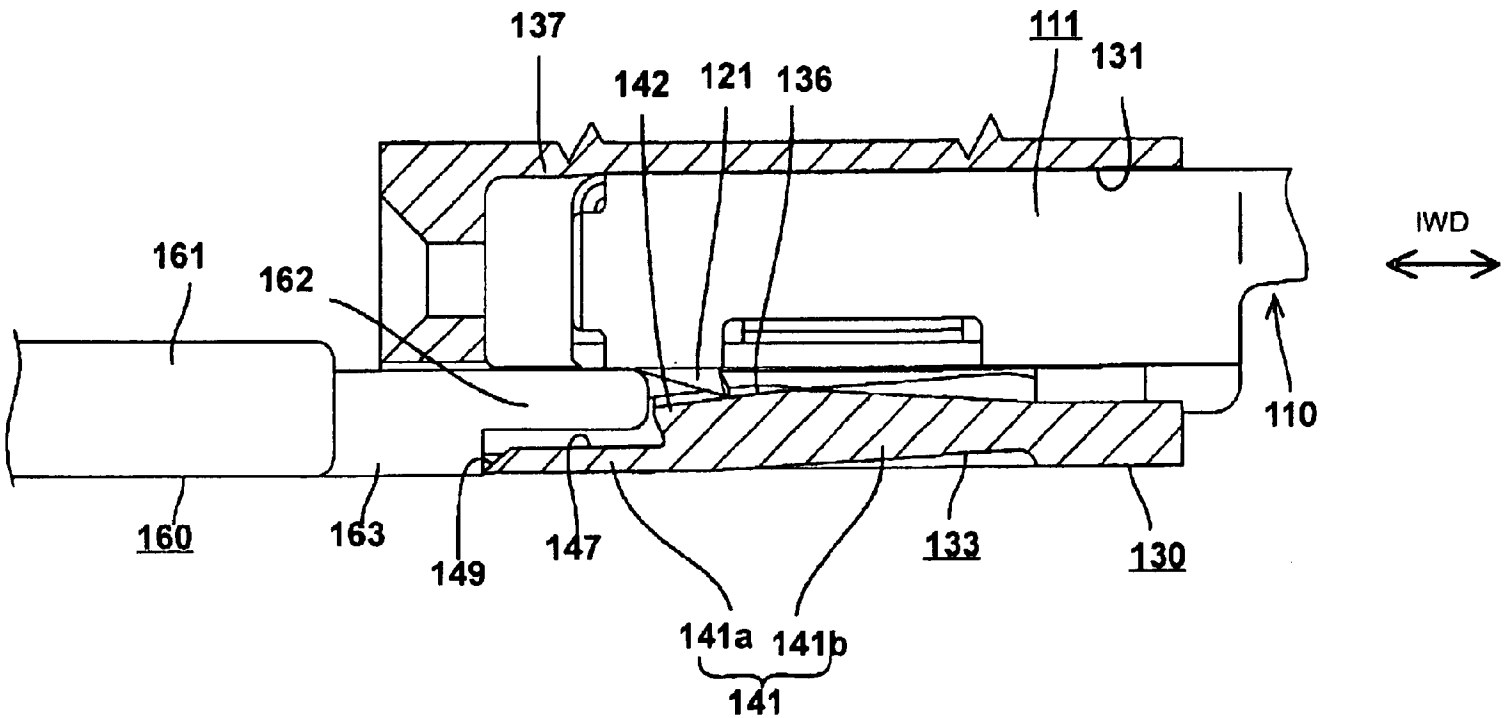
FIG. 22 is an enlarged section showing a state where the female terminal fitting is moved backward by the disengaging portion.

The disengaging portion 162 is inserted from the position P3 towards the back of the jig insertion space 148 and slides along the guiding slanted surface 121*a*. Thus, the disengaging portion 162 is guided down in the deforming direction DD by the guiding slanted surface 121*a* and pushes the pushable projection 121 back. At this time, the lock 133 still engages the female terminal fitting 110 and prevents backward movement of the female terminal fitting 110. However, the guiding slanted surface 121*a* guides the disengaging portion 162 farther down in the deforming direction DD in response to further insertion of the disengaging portion 162, and hence the disengaging portion 162 presses the lock 133 farther down in the deforming direction DD. The upper locking surface 146 disengages completely from the pushable projection 121 when the disengaging portion 162 reaches the position P4 in the jig insertion space 148, as shown in FIG. 21. As a result, the locked state of the female terminal fitting 110 by the lock 133 is canceled. Accordingly, a pushing force by the disengaging projection 162 on the pushable projection 121 pushes the female terminal fitting 110 back by a distance corresponding to a distance between P3 and P4, and the disengaging portion 162 is displaced up to the initial height where the upper surface of the disengaging portion 162 contacts the bottom surface of the main portion 111. The main portion 111 moves up away from the lock 133 and into the escape space 138 behind the bulge 137 in the process of moving the female terminal fitting 110 backward. Thus, the locked state is canceled smoothly. The disengaging portion 162 is pushed farther back in this state, and the female terminal fitting 110 is moved back by as much as this stroke as shown in FIG. 22. The restricting portion 162 contacts the slanted surface 149 to stop the disengaging portion 162 slightly before the fastening projection 142. As a result, further insertion of the disengaging portion 162 is prevented. The wire W can be pulled back to withdraw the female terminal fitting 110 from the cavity 131 after the locked state of the female terminal fitting 110 is canceled.

The degree of engagement may be larger than described above due to a variation in the degree of the engagement of the lock 133 and the female terminal fitting 110 from product to product. However, the lock 133 can be deformed farther down from the state of FIG. 21 by pushing the disengaging portion 162 further back from the position P4. Thus, even in such a case, the locked state of the lock 133 can be canceled.

The pushable projection 121 enters the projection-introducing groove 136 in the fastening projection 142, as shown in FIG. 22, when the female terminal fitting 110 has been moved back by the disengaging portion 162. Thus, the projecting end of the pushable projection 121 presses and resiliently deforms the lock 133. Additionally the bottom surface of the groove 147 is disengaged from the disengaging portion 162. Accordingly, the lock 133 remains deformed by the pushable projection 121 and the locked state remains canceled even if the jig 160 is pulled to withdraw the disengaging portion 162 from the jig insertion space 148. Thus, all the female terminal fittings 110 can be withdrawn at once by pulling the wires W together after all the locks 133 are disengaged from the corresponding female terminal fittings 110 by the jig 160.

As described above, one disengaging portion 162 performs a function of resiliently deforming the locks 133 and a function of moving the female terminal fittings 110 backward. Thus, the jig 160 is simple and the female terminal fittings 110 can be detached more efficiently as compared to a case where two special parts are needed for these functions, as in the prior art.

Further, the slanted surface 149 enables the disengaging portion 162 to be inserted smoothly into the jig insertion space 148 and enables the lock 133 to be deformed gradually.

The guiding slanted surface 121*a* smoothly guides the disengaging portion 162 in the unlocking direction of the lock 133, and hence smoothly cancels the locked state of the female terminal fitting 110 by the lock 133.

The pushable projection 121 is engaged with the lock 133 to improve the locking force for locking the female terminal fitting 110.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

In the foregoing embodiment, the lock is not deformed sufficiently to cancel the locked state when the disengaging portion contacts the pushable projection. However, the lock may be deformed to such a position before contacting the pushable projection.

The thickness of the disengaging portion is substantially constant and the height of the jig insertion space is changed in the foregoing embodiment. However, the thickness of the disengaging portion may gradually increase from the leading end towards the back end. In such a case, the height of the jig insertion space may be substantially constant.

The slanted surface is formed only at the front end of the lock in the foregoing embodiment. However, a slanted surface for guiding the disengaging portion may extend from the introducing part to the pushable projection.

The pushable projection need not be tapered. Neither may the pushable projection serve as an engageable portion with the lock, and an engageable portion may be separately provided.

The jig may be guided in the unlocking direction of the lock by a guiding surface of the pushable projection before being guided by the slanted surface of the lock.

The lock need not be supported at both ends and may be supported only at one end. Further, the invention is also applicable to male connectors provided with male terminal fittings.

What is claimed is:

1. A connector for use with a jig having disengaging portion with a selected thickness dimension, said connector, comprising:

a housing with at least one cavity, at least one lock in the cavity, the lock being resiliently deformable along a deforming direction;

a terminal fitting insertable into and withdrawable from the cavity along inserting and withdrawing directions and configured to be locked by the lock, the terminal fitting having a pushable projection projecting towards the lock;

a jig insertion space defined between the terminal fitting and the lock, a dimension of the jig insertion space along the deforming direction being smaller than a dimension of the disengaging portion along the deforming direction, and a difference between said dimension of the jig insertion space and said dimension of the disengaging portion being at least equal to a displacement of the lock needed to cancel a locked state of the terminal fitting, whereby the locked state of the terminal fitting can be canceled by inserting the jig linearly along the inserting and withdrawing directions.

2. The connector of claim 1, wherein the lock has an introduction guiding slanted surface with an inclination for gradually decreasing the dimension of the jig insertion space substantially along the deforming direction of the lock.

3. The connector of claim 1, wherein the pushable projection is widened so that a projecting distance thereof is increased gradually, and a guiding slanted surface is formed on an outer surface of the pushable projection for guiding the disengaging portion in an unlocking direction of the lock by sliding contact with the disengaging portion.

4. The connector of claim 1, wherein the pushable projection is engageable with the lock to be locked.

5. A connector assembly, comprising:

a housing with at least one cavity, at least one lock in the cavity, the lock being resiliently deformable along a deforming direction, the lock having a front surface and a fastening projection rearward of the front surface by a selected spacing;

a terminal fitting insertable into and withdrawable from the cavity along inserting and withdrawing directions and having a projection projecting towards the lock and configured to be locked by the lock;

a jig insertion space defined between the terminal fitting (110) and the lock and defining a dimension along the deforming direction; and a jig having a disengaging portion with a thickness that exceeds the dimension of the jig insertion space by a distance at least equal to a displacement of the lock needed to separate the fastening projection from the projection of the lock, the jig further having a restricting portion spaced from a front end of the disengaging portion by a distance less than the spacing between the front surface of the lock and the fastening projection of the lock, whereby the locked state of the terminal fitting can be canceled merely by inserting the jig linearly along the inserting and withdrawing directions.

6. A method for detaching a terminal fitting locked by a lock in a cavity of a housing, comprising the following steps:

inserting a disengaging portion of a jig substantially linearly along an inserting and withdrawing direction into a jig insertion space defined between the terminal fitting and the lock;

urging the disengaging portion substantially linearly along the inserting and withdrawing direction against the lock for resiliently deforming the lock in an unlocking direction sufficiently for canceling a locked state of the terminal fitting; and urging the disengaging portion substantially linearly along the inserting and withdrawing direction against a pushable projection on the terminal fitting to move the unlocked terminal fitting backward substantially linearly along the inserting and withdrawing direction.

7. The method of claim 6, wherein a dimension of the jig insertion space along a resilient deforming direction of the lock is less than a dimension of a disengaging portion of the jig along the resilient deforming direction, and a difference between said dimension of the disengaging portion and said dimension of the jig insertion space substantially equals a displacement of the lock needed to cancel the locked state of the terminal fitting.

* * * * *